US007268743B2

(12) United States Patent
Lin

(10) Patent No.: US 7,268,743 B2
(45) Date of Patent: Sep. 11, 2007

(54) ADJUSTABLE ANTENNA BRACKET

(76) Inventor: Ming-Tien Lin, No. 206, Cheng Kung 3rd Road, Nan Kang Industrial Park, Nantou City (TW)

( * ) Notice: Subject to any disclaimer, the term of this patent is extended or adjusted under 35 U.S.C. 154(b) by 89 days.

(21) Appl. No.: 11/296,503

(22) Filed: Dec. 8, 2005

(65) Prior Publication Data

US 2007/0132655 A1 Jun. 14, 2007

(51) Int. Cl.
*H01Q 1/08* (2006.01)
*H01Q 3/02* (2006.01)
*H01Q 1/12* (2006.01)

(52) U.S. Cl. ..... 343/880; 343/882; 343/892

(58) Field of Classification Search ..... 343/878, 343/880, 882, 892

See application file for complete search history.

(56) References Cited

U.S. PATENT DOCUMENTS 5,941,497 A * 8/1999 Inoue et al. ..... 248/514
7,113,144 B2 * 9/2006 Lin et al. ..... 343/880
7,164,391 B2 * 1/2007 Lin et al. ..... 343/882

* cited by examiner

*Primary Examiner*—Shih-Chao Chen
(74) *Attorney, Agent, or Firm*—Lowe Hauptman Ham & Berner, LLP

(57) ABSTRACT

An adjustable antenna bracket has an antenna bracket, a stanchion bracket, a connector panel and multiple fasteners. The antenna bracket has a fixed board with multiple circular assembled curved slots and the fixed board is combined with the antenna bracket. The stanchion bracket has a connecting board, two elevation boards and two adjusting boards. Each adjusted board has multiple adjusted slots. The connector panel is mounted on the antenna bracket at a side opposite to the stanchion bracket. The fasteners extend through the connector panel, the curved slots in the antenna disk and the adjusting slots in the adjusting boards to combine the connector panel, the antenna disk and the stanchion bracket together. Accordingly, an adjustable antenna bracket with two rotation stages is provided.

14 Claims, 9 Drawing Sheets

ADJUSTABLE ANTENNA BRACKET

BACKGROUND OF THE INVENTION

1. Field of the Invention

The present invention relates to an adjustable antenna bracket, and more particularly to an adjustable antenna bracket to adjust a satellite antenna. The adjustable antenna bracket can adjust the direction the satellite antenna points. The adjustable antenna bracket can improve signal quality.

2. Description of Related Art

To receive satellite signals such as video, telephone and the like, a satellite antenna receives and transmits signals from and to a satellite.

With reference to FIG. 9, a satellite antenna has a concave antenna dish with a rear surface and is generally mounted with an adjustable antenna bracket (60). The adjustable antenna bracket (60) generally comprises an antenna bracket (61), a stanchion bracket (62) and multiple fasteners (65).

The antenna bracket (61) is attached to the rear surface of the antenna dish and comprises a face and two curved slots (63). In addition, the curved slots (63) are formed in a circle through the face of the antenna bracket (61).

The stanchion bracket (62) is connected rotatably to the antenna bracket (61) and has a face and three through holes (64) corresponding to the curved slots (63).

The fasteners (65) are mounted respectively through the curved slots (63) and the corresponding through holes (64) to attach the antenna bracket (61) to the stanchion bracket (62).

When the fasteners (65) are loosened, the antenna bracket (61) and the antenna dish can be rotated on the stanchion bracket (62).

Defects and shortcomings of the conventional adjustable antenna bracket (60) follow.

1. The adjusted angle of the adjustable antenna bracket (60) is restricted between the curved slots (63) and the fasteners (65).

2. The antenna dish cannot adjust to the best location and angle. Therefore the quality of the message is leaded to reduce.

SUMMARY OF THE INVENTION

The main objective of the present invention is to provide an adjustable antenna bracket with two-axis adjustment and multiple ways to adjust the angle of an antenna dish.

The adjustable antenna bracket comprises an antenna bracket, a stanchion bracket, a connector panel and multiple fasteners. The antenna bracket has a fixed board with multiple circular assembled curved slots and the fixed board is combined with the antenna bracket. The stanchion bracket comprises a connecting board, two elevation boards and two adjusting boards. The elevation boards are mounted respectively on the sides of the connecting board. The adjusting boards are mounted on the end of the connecting board, are connected respectively on the elevation boards. Each adjusting board has multiple adjusting slots corresponding to the curved slots in the fixed board, and each adjusting slot has two ends. The connector panel is mounted on the fixed board at a side opposite to the adjusting board and has multiple connecting holes. The fasteners are mounted respectively through the connecting holes in the connected board, the curved slots in the fixed board and the adjusting slots in the adjusted board to combine the connector panel, the antenna bracket and the stanchion bracket together.

DETAILED DESCRIPTION OF THE PREFERRED EMBODIMENT

Figure 1:
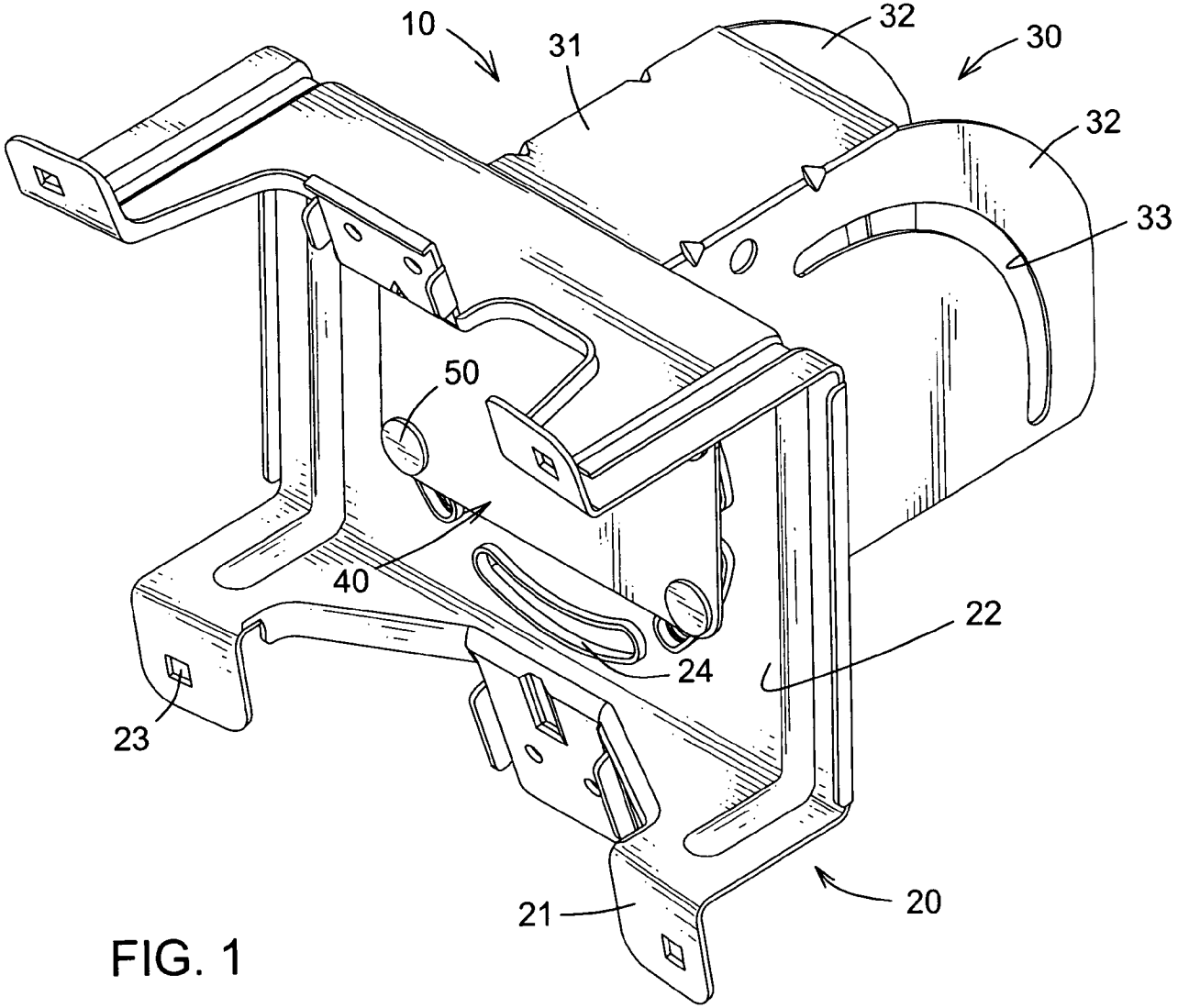
FIG. 1 is a perspective view of an adjustable antenna bracket in accordance with the present invention.
Figure 2:
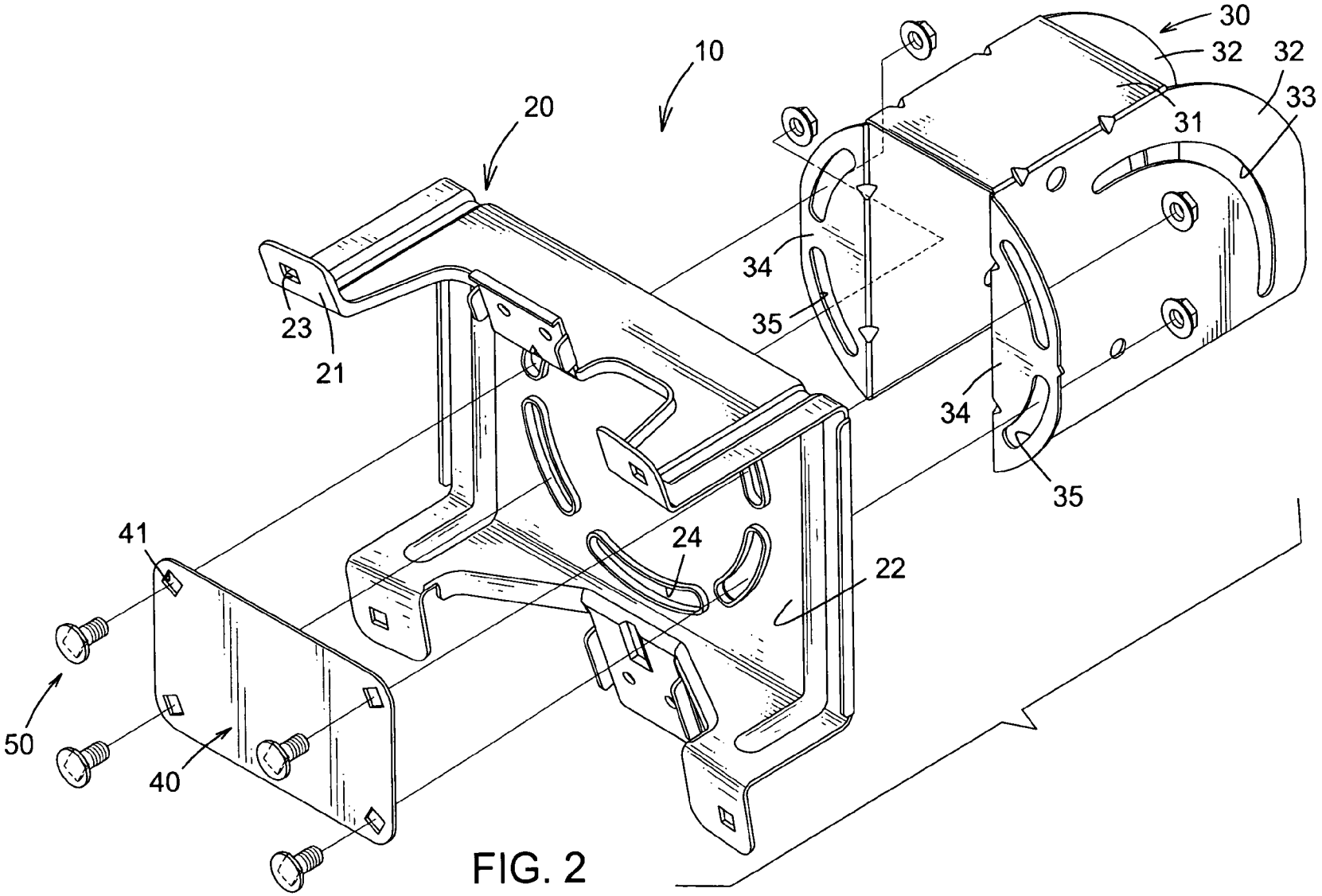
FIG. 2 is an exploded perspective view of the adjustable antenna bracket in FIG. 1.
Figure 3:
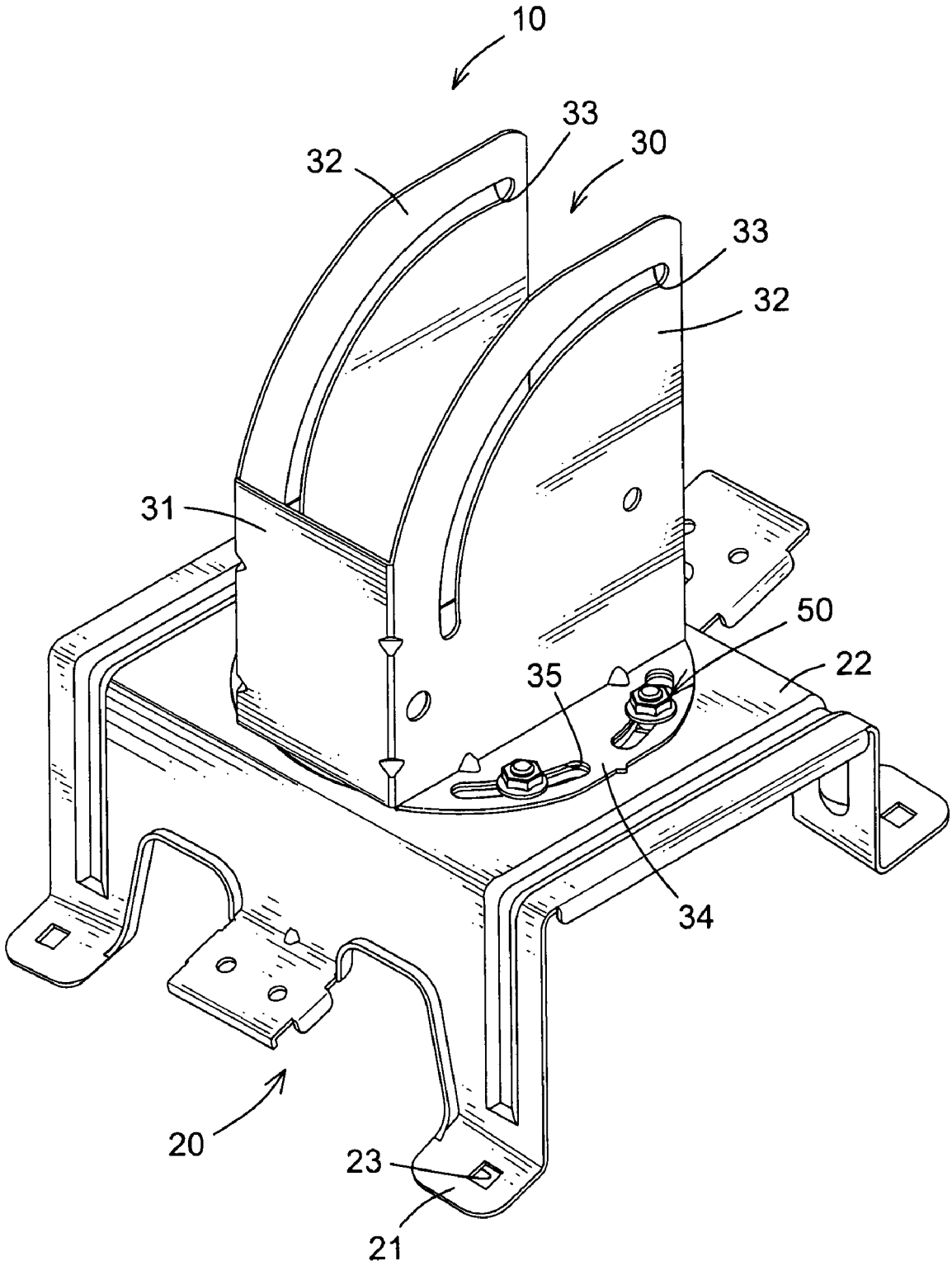
FIG. 3 is a perspective view of the adjustable antenna bracket in FIG. 1.

With reference to FIGS. 1, 2 and 3, an adjustable antenna bracket (10) in accordance with the present invention comprises an antenna bracket (20), a stanchion bracket (30), a connector panel (40) and multiple fasteners (50).

The antenna bracket (20) has multiple connected feet (21), a fixed board (22) and multiple curved slots (24). The connected feet (21) are mounted on and extend from the fixed board (22) to combine the antenna dish with the antenna bracket (20). In addition, each connected foot (21) has a connected hole (23) to connect with the antenna dish. Furthermore the multiple curved slots (24) are defined in the fixed board (22) in a circle and each has two ends.

The stanchion bracket (30) is mounted on the fixed board (22) of the antenna bracket (20) and is a U-shape seat. In addition, the stanchion bracket (30) comprises a connecting board (31), two elevation boards (32) and two adjusting boards (34). The connecting board (31) is a square board, and the elevation boards (32) are mounted on two sides of the connecting board (31) respectively. Each elevation board (32) has a curved elevation slot (33). The adjusting boards (34) are mounted on one end of the connecting board (31) and connected respectively with the elevation boards (32), and each adjusting board (34) is a semicircle-shaped board. Each adjusting board (34) has two adjusting slots (35) corresponding respectively to the curved slots (24) in the fixed board (22), and each adjusting slot (35) has two ends.

The connector panel (40) is mounted with the fixed board (22) of the antenna bracket (20) at a side opposite to the adjusting boards (34). The connector panel (40) is a square board and has multiple connecting holes (41).

The fasteners (50) are mounted through the connecting holes (41) of the connector panel (40), the curved slots (24) of the fixed board (22) and the adjusting slot (35) in the adjusting board (34). Each fastener (50) comprises a bolt and a nut.

With reference to FIG. 2, to assemble the adjustable antenna bracket (10), the bolts of the fasteners (50) (50) respectively extend through the corresponding connecting hole (41) in the connector panel (40), the curved slots (24) in the fixed board (22) and the adjusting slots (35) in each adjusted board (34) and are screwed with the nuts. Accordingly, the antenna bracket (20), the stanchion bracket (30)

and the connector panel (40) are combined together by the fasteners (50) to achieve the adjustable antenna bracket (10) as showed in FIGS. 1 and 3.

Figure 4:
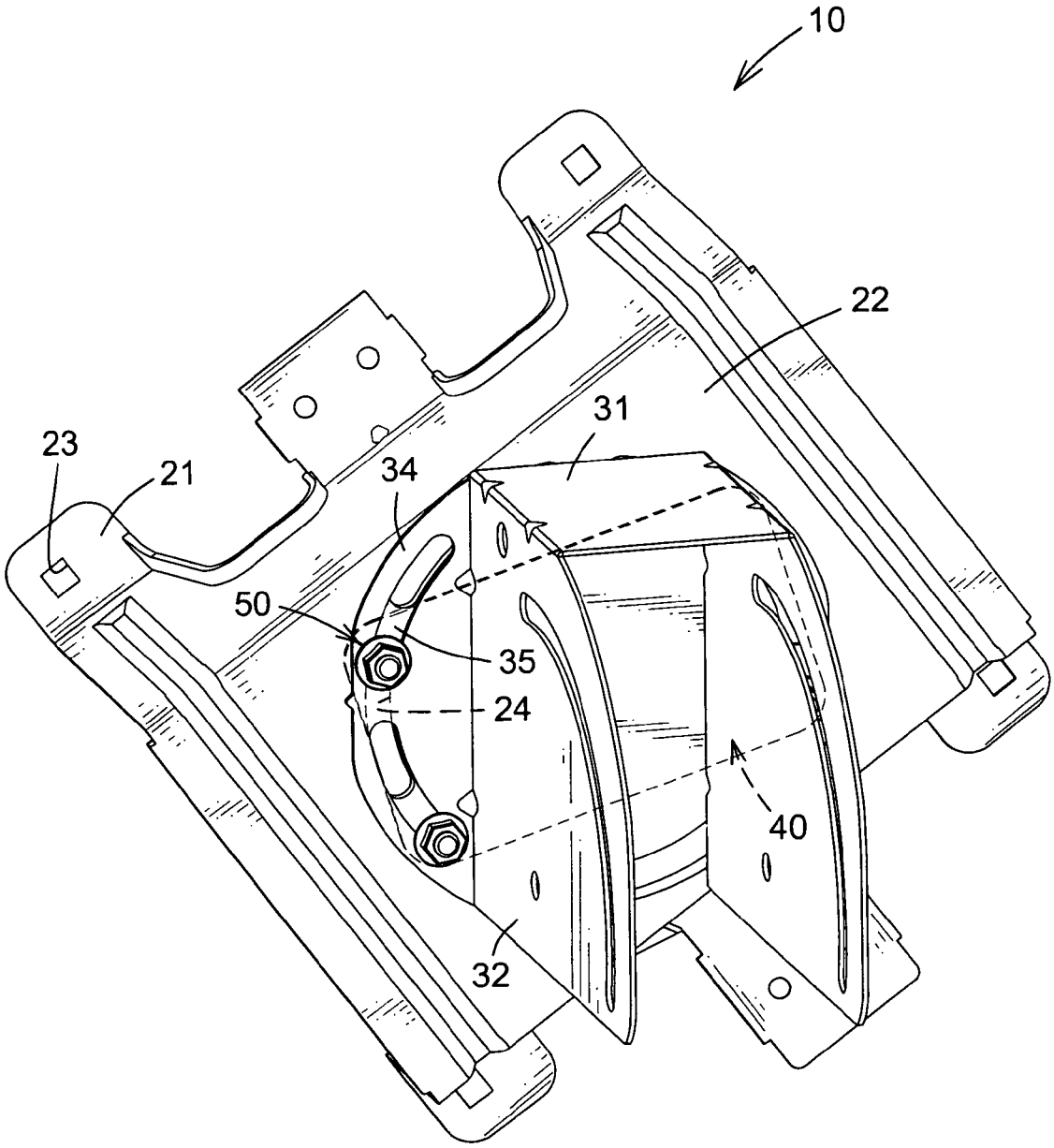
FIG. 4 is an operational perspective view of the adjustable antenna bracket in FIG. 1.
Figure 5:
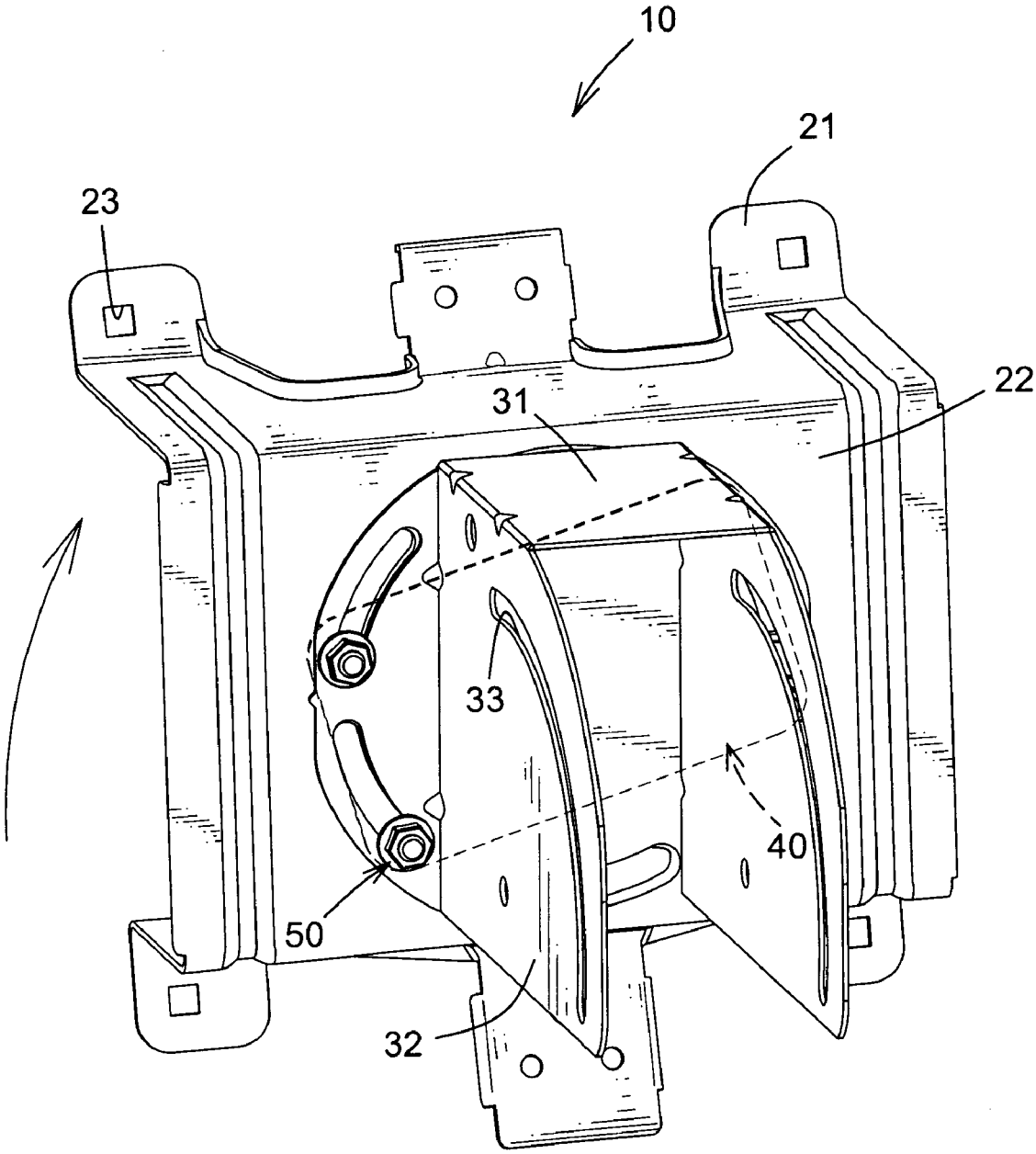
FIG. 5 is an operational perspective view of the adjustable antenna bracket in FIG. 1.
Figure 6:
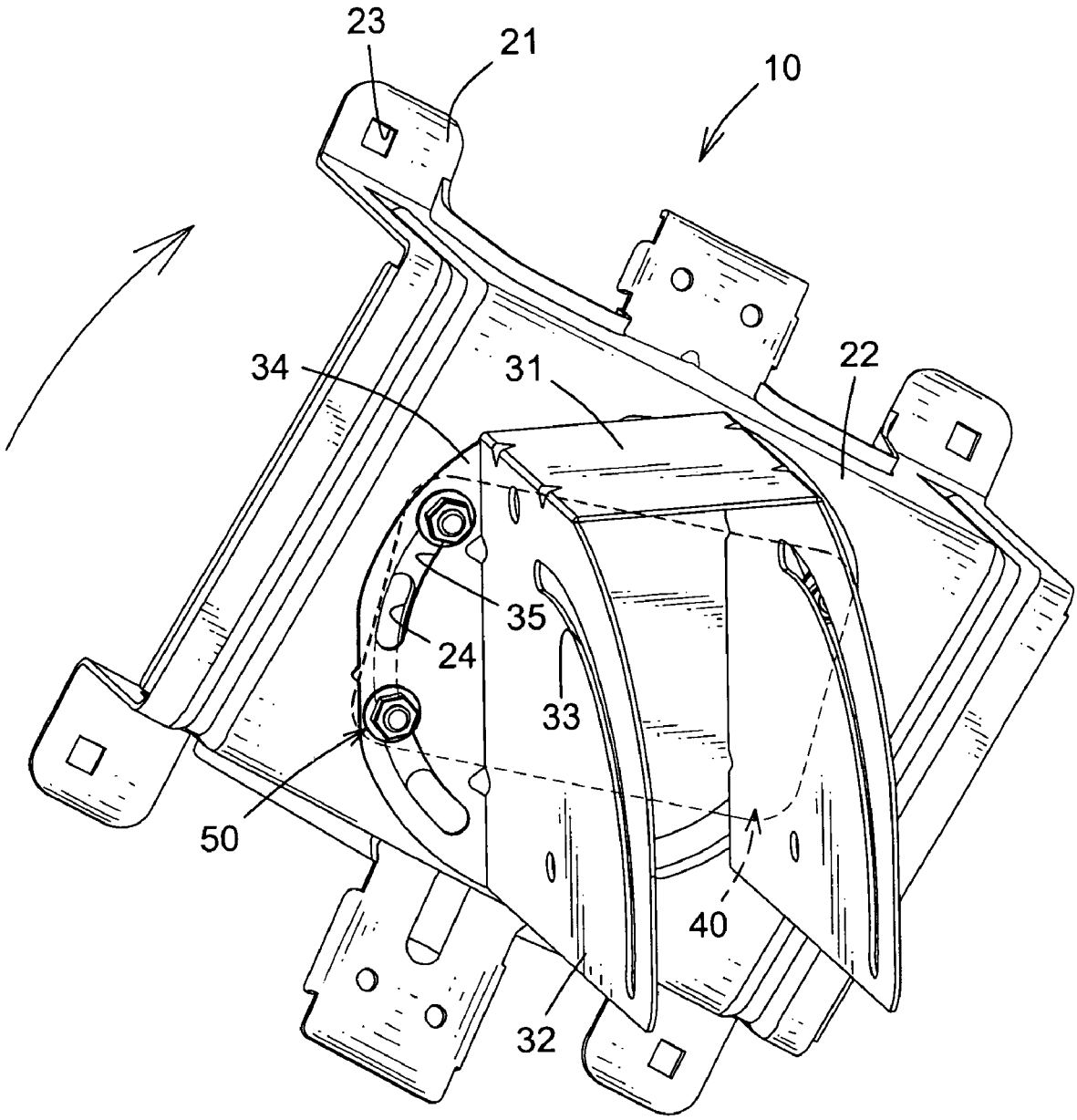
FIG. 6 is an operational perspective view of the adjustable antenna bracket of FIG. 1.

With reference to FIGS. 4, 5 and 6, after loosening the fasteners (50), the adjustable antenna bracket (10) has two rotation stages. In the first rotation stage, with reference to FIG. 4, the antenna bracket (20) is rotated relative to the stanchion bracket (30) along the curved slots (24) until the fasteners (50) abut against ends of the corresponding curved slots (24) as shown in FIG. 5. In the second rotation stage, with reference to FIG. 6, the antenna bracket (20) is further rotated to make the fasteners (50) to move along the adjusting slots (35) in the adjusting board (34). Accordingly, the adjustable antenna bracket (10) of the present invention can provide two rotation stages and a large adjusting range to the antenna dish.

Figure 7:
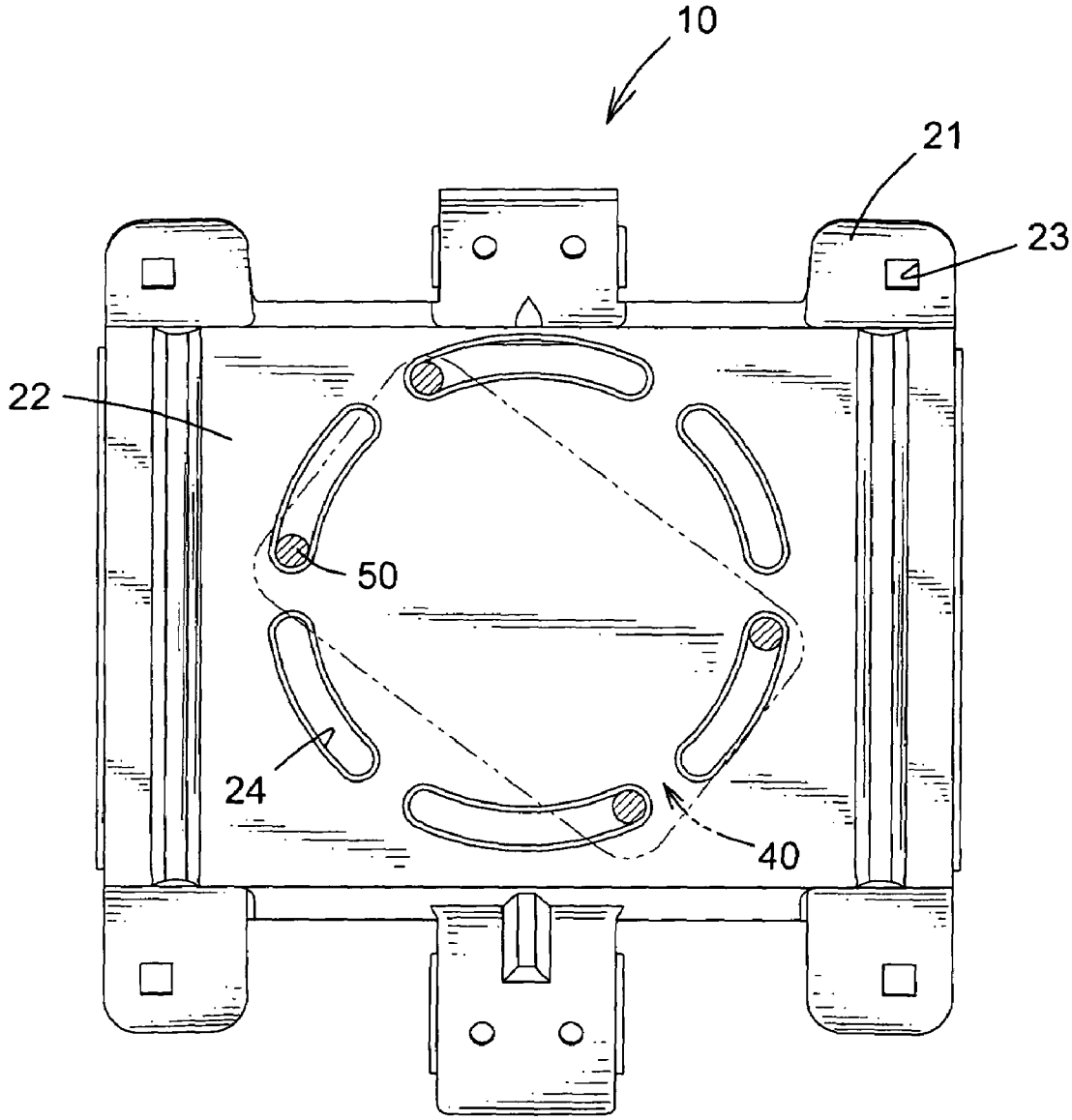
FIG. 7 is an operational top view of the adjustable antenna bracket in FIG. 1.
Figure 8:
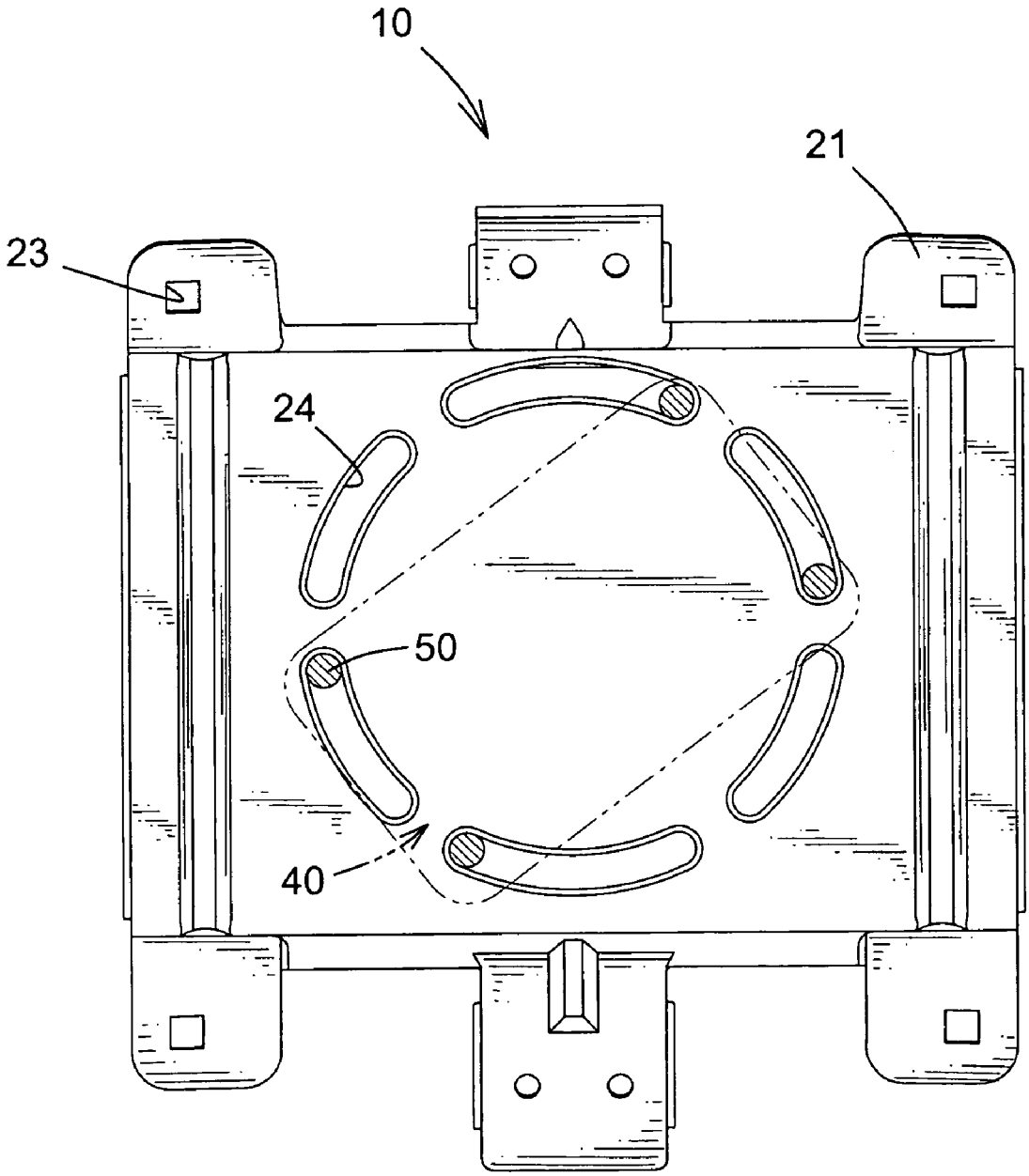
FIG. 8 is an operational top view of the adjustable antenna bracket in FIG. 1.
Figure 9:
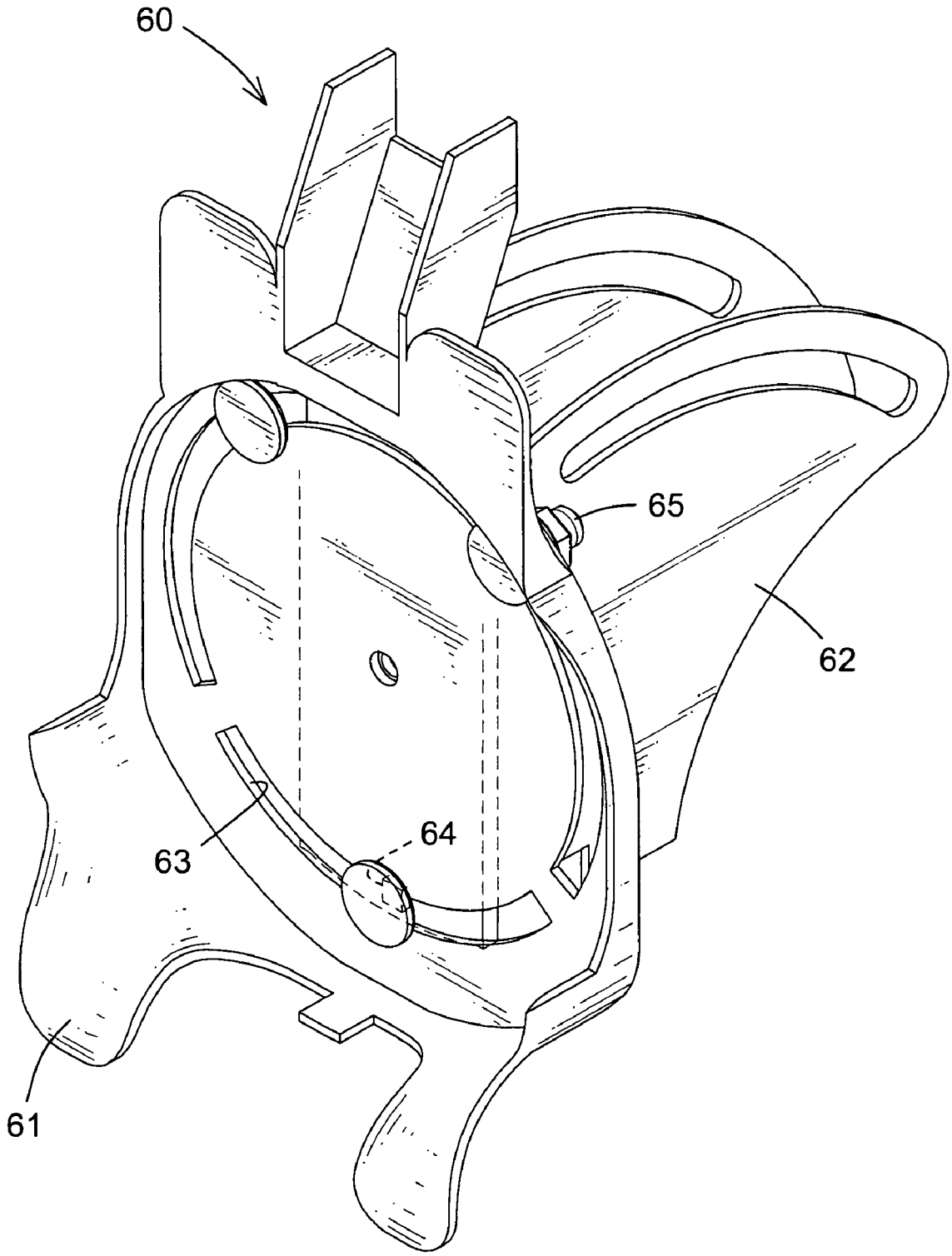
FIG. 9 PRIOR ART
FIG. 9 is a perspective view of a conventional adjustable antenna bracket in accordance with the prior art.

In alternative embodiments, the fasteners (50) can fixed in different curved slot (24) in the antenna bracket (20) as FIGS. 7 and 8 shown. Accordingly, the antenna bracket (20) can rotate relative to the stanchion bracket (30) in different direction to the previously operation of the adjustable antenna bracket (10).

The adjustable antenna bracket (10) as described has the following advantages.

1. The adjusted angle of the adjustable antenna bracket (10) is wide by the two rotations stages.

2. The antenna dish can adjust to the best location and angle by adjusting the adjustable antenna bracket (10) and the quality of the massage is improved.

Even though numerous characteristics and advantages of the present utility model have been set forth in the foregoing description, together with details of the structure and features of the utility model, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An adjustable antenna bracket comprising an antenna bracket having a fixed board;

multiple connected feet mounted on and extending from the fixed board to combine an antenna dish with the antenna bracket; and multiple curved slots defined in the fixed board in a circle and each having two ends;

a stanchion bracket mounted on the fixed board of the antenna bracket and comprising a connecting board with two sides and one end;

two elevation boards mounted respectively on the sides of the connecting board; and two adjusting boards mounted on the end of the connecting board, connected respectively on the elevation boards and each having multiple adjusting slots corresponding to the curved slots in the fixed board, and each adjusting slot having two ends;

a connector panel mounted on the fixed board at a side opposite to the adjusting board and having multiple connecting holes; and multiple fasteners mounted respectively through the connecting holes in the connected board, the curved slots in the fixed board and the adjusting slots in the adjusted board to combine the connector panel, the antenna bracket and the stanchion bracket together.

2. The adjustable antenna bracket as claimed in claim 1, wherein each connected foot has a connected hole for combining with the antenna dish.

3. The adjustable antenna bracket as claimed in claim 2, wherein the stanchion bracket is a U-shaped seat.

4. The adjustable antenna bracket as claimed in claim 3, wherein the connecting board is a square board.

5. The adjustable antenna bracket as claimed in claim 4, wherein each elevation board has a curved elevation slot.

6. The adjustable antenna bracket as claimed in claim 5, wherein each adjusting board is a semicircle-shaped board.

7. The adjustable antenna bracket as claimed in claim 6, wherein the connector panel is a square board.

8. The adjustable antenna bracket as claimed in claim 7, wherein each fastener comprises a bolt and a nut.

9. The adjustable antenna bracket as claimed in claim 1, wherein the stanchion bracket is a U-shaped seat.

10. The adjustable antenna bracket as claimed in claim 1, wherein the connecting board is a square board.

11. The adjustable antenna bracket as claimed in claim 1, wherein each elevation board has a curved elevation slot.

12. The adjustable antenna bracket as claimed in claim 1, wherein each adjusted board is a semicircle-shaped board.

13. The adjustable antenna bracket as claimed in claim 1, wherein the connector panel is a square board.

14. The adjustable antenna bracket as claimed in claim 1, wherein each fastener comprises a bolt and a nut.

* * * * *